US006431856B1

(12) United States Patent
Maenishi et al.

(10) Patent No.: US 6,431,856 B1
(45) **Date of Patent: *Aug. 13, 2002**

(54) CATALYTIC COMBUSTION APPARATUS

(75) Inventors: Akira Maenishi, Ikeda; Masato Hosaka; Tatsuo Fujita, both of Osaka; Yoshitaka Kawasaki, Nabari; Jiro Suzuki, Nara; Motohiro Suzuki, Moriguchi, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/894,874

(22) PCT Filed: Dec. 6, 1996

(86) PCT No.: PCT/JP96/03582

§ 371 (c)(1),
(2), (4) Date: Aug. 14, 1997

(87) PCT Pub. No.: WO97/21957

PCT Pub. Date: Jun. 19, 1997

(30) Foreign Application Priority Data

Dec. 14, 1995 (JP) ..... 7-326100
Apr. 19, 1996 (JP) ..... 8-097866

(51) Int. Cl.[7] ..... F23H 5/00; F23D 14/18

(52) U.S. Cl. ..... 431/328; 431/7; 431/326; 122/4 D; 126/92 R; 126/92 AC; 126/92 C

(58) Field of Search ..... 431/326, 329, 431/7, 328, 79, 78; 165/53, 56, 904, 138, 169; 122/4 D; 126/350 R, 92 C, 91 R, 116 A, 92 AC, 92 R

(56) References Cited

U.S. PATENT DOCUMENTS

| | | | | | |
|---|---|---|---|---|---|
| 3,199,505 | A | * | 8/1965 | Lloyd | 431/328 |
| 3,362,792 | A | * | 1/1968 | Ranum | 431/329 |
| 3,709,473 | A | * | 1/1973 | Ito et al. | 126/350 R |
| 4,015,586 | A | * | 4/1977 | Vroom et al. | 126/640 |
| 4,089,303 | A | * | 5/1978 | Brulfert | 431/328 |
| 4,215,675 | A | * | 8/1980 | Embree | 126/623 |
| 4,459,126 | A | * | 7/1984 | Krill et al. | 431/7 |

(List continued on next page.)

FOREIGN PATENT DOCUMENTS

| | | | |
|---|---|---|---|
| EP | 225929 | * 10/1985 | 126/350 |
| FR | 1 323 375 | 7/1963 | |
| FR | 2 694382 | 2/1994 | |
| JP | 5-1816 | 1/1993 | |
| JP | 5-113203 | 5/1993 | |
| JP | 5-203118 | 8/1993 | |
| JP | 6-147419 | 5/1994 | |

OTHER PUBLICATIONS

Internationa Search Report (6 pp. ).

*Primary Examiner*—Carl D. Price
(74) *Attorney, Agent, or Firm*—Ratner & Prestia

(57) ABSTRACT

In order to realize a catalytic combustion apparatus capable of effectively utilizing radiation from a surface of a catalytic element, providing a higher efficiency of heat exchange, and characterized in superior characteristics of an exhaust gas, a catalytic combustion apparatus according to the invention comprises a catalytic element 7 in the shape of a plate consisting of multiple through-holes for combusting a mixed gas of a fuel gas and air and a combustion chamber 6 accommodating the catalytic element 7, and incorporating a radiated heat receiving plate 11 that is positioned in opposition to either one of two surfaces of the catalytic element 7 as a part of its side walls.

12 Claims, 9 Drawing Sheets

U.S. PATENT DOCUMENTS 4,480,988 A * 11/1984 Okabayashi et al. ..... 431/329
4,664,620 A * 5/1987 Kendall et al. ..... 431/328
4,751,913 A * 6/1988 Vetter ..... 126/350 R
4,751,914 A * 6/1988 Jackson ..... 431/326
4,953,512 A * 9/1990 Italiano ..... 431/170
5,158,448 A 10/1992 Kawasaki et al.
5,375,999 A * 12/1994 Aizawa et al. ..... 431/328
5,711,661 A * 1/1998 Kushch et al. ..... 431/329
5,901,700 A * 5/1999 Suzuki et al. ..... 431/7

* cited by examiner

CATALYTIC COMBUSTION APPARATUS

This application is the U.S. national-phase application of PCT International Application NO. PCT/JP96/03582.

TECHNICAL FIELD

The present invention relates to a catalytic combustion apparatus superior in characteristics of an exhaust gas for catalytically combusting a gaseous fuel or liquid fuel that is vaporized, and utilizing the combustion heat and exhaust gas for such applications as heating, air heating and drying.

BACKGROUND ART

Conventionally, a catalytic combustion apparatus for catalytically combusting a gaseous or liquid fuel for heating, air heating and drying has been generally constituted as shown in FIG. 9.

By using FIG. 9, the constitution is described. In FIG. 9, a fuel gas supplied from a fuel supply valve 1 is mixed in a premixing chamber 3 with air supplied from an air supply valve 2, and sent to a preheating burner 4 as a premixed gas. It is ignited by an ignition device 5, and forms a flame at the preheating burner 4. An exhaust gas of a high temperature caused by the flame heats a catalytic element 7 provided in a combustion chamber, passes there through, and is discharged from an outlet 8. When the catalytic element 7 is heated to a temperature at which it is active, supply of the fuel is temporarily discontinued by the fuel supply valve 1, and the flame is distinguished. By restarting supply of the fuel immediately after that, catalytic combustion is initiated. The catalytic element reaches a high temperature, and emits heat radiantly through a glass 9 that is located in a position opposite to an upstream surface of the catalytic element as well as in the form of a hot exhaust gas from the outlet 8 for heating and air heating applications.

Because the catalytic combustion is surface combustion, a large quantity of radiation is emitted from the catalytic element in correspondence with a temperature of the catalytic element and an apparent surface area of the catalytic element. In a catalytic combustion apparatus for heating and air heating by means of heat exchange using a heating medium, combustion heat generated on the catalytic element must be efficiently exchanged with the heating medium. It is, therefore, required that a radiation from a surface of the catalytic element is effectively exchanged. However, it has been a problem that an efficiency of heat exchange of a catalytic combustion apparatus is reduced correspondingly, if heat radiated from the catalytic element, instead of being conducted to a heat exchanger, is applied to, other outer wall of the combustion apparatus, or emitted outside the combustion apparatus.

Thus, in order to solve the problem, the invention intends to realize a catalytic combustion apparatus effectively utilizing a radiation from a surface of catalytic element for providing a high efficiency of heat exchange.

Further, in the case a catalytic element is employed in a combustion chamber, combustion heat on the catalytic element is conducted by thermal conduction to the combustion chamber from an attachment part to the combustion chamber.

Therefore, it has been a problem that the catalytic element is lower in temperature in the vicinity of a catalytic element holder, the catalytic activity is locally reduced, and an exhaust gas containing unburned combustibles is emitted.

Hence, it is an object of the invention to prevent emission of unburned combustibles from an attachment part of catalytic element to a combustion chamber, and provide a catalytic combustion apparatus superior in characteristics of an exhaust gas.

In addition, in the case sensible heat of a combustion gas is exchanged by means of such heat exchanger as a fin-tube type, when the heat exchanger is placed above a catalytic element, because combustion heat is used for raising the temperature of the combustion apparatus itself at the time of startup of the combustion apparatus, and the temperature of an exhaust gas cannot be very high, condensation is caused on the heat exchanger, and the catalytic element may be wetted. If the catalytic element is wetted by the condensed water, the temperature is reduced, the catalytic activity is lowered, and the reactivity may be locally reduced. Also, as condensation on the heat exchanger should not be allowed, positive heat exchange was unachievable, and it was forced that the latent heat in the combustion gas be discharged as an exhaust loss instead of being collected.

Thus, in order to solve the problem, the invention intends to prevent combustion characteristics from being locally affected by condensed water, and allow stable combustion to be maintained by providing a heat exchanger above a heat exchanger, and discharging water condensed on the heat exchanger to outside a combustion apparatus. The invention also intends to realize a catalytic combustion apparatus providing a very high efficiency of heat exchange by collecting latent heat in a combustion gas at the same time.

DISCLOSURE OF THE INVENTION

The invention provides, as defined in claim 1, a catalytic combustion apparatus comprising a fuel supply member for supplying a fuel, an air supply member for supplying combustion air, a premixing chamber for mixing the fuel supplied from the fuel supply member and the air supplied from the air supply member to make a mixed gas, a catalytic element in the shape of a plate consisting of a porous member for catalytically combusting the mixed gas and a combustion chamber provided in a downstream side of the premixing chamber, containing the catalytic element in the shape of a plate, and incorporating a first radiated heat receiving member that is positioned opposite to either one of two surfaces of the catalytic element as a part of its side wall.

The first radiated heat receiving member may have a heating medium channel tightly adhered thereto or incorporated therein.

The combustion chamber may incorporate a second radiated heat receiving member that is positioned opposite to the other of two surfaces of the catalytic element as a part of its side wall.

The second radiated heat receiving member may have a heating medium channel tightly adhered thereto or incorporated therein.

In an outlet of the combustion chamber, a second catalytic element in the shape of a plate consisting of a porous member may be provided.

A radiation absorbing layer may be employed in a surface of the first radiated heat receiving member inside the combustion chamber.

A radiation absorbing layer may be provided in a surface of the second radiated heat receiving member inside the combustion chamber.

The catalytic combustion apparatus further comprises a heat exchanging member provided in a downstream side of the combustion chamber, wherein the combustion chamber may be located above the heat exchanging member.

The invention provides, as defined in claim 9, a catalytic combustion apparatus comprising a catalytic element with multiple through-holes for combusting a mixed gas of a fuel and air, a combustion chamber containing the catalytic element, and having a radiated heat receiving member that is positioned opposite to an upstream side of the catalytic element in the flowing direction of the mixed gas, a first heating medium channel provided in the radiated heat receiving plate, a second heating medium channel located downstream of the catalytic element in the flowing direction, and having multiple fins and an exhaust path formed between the fins, wherein the multiple fins are placed at least in a position opposite to either end of the catalytic element.

According to such constitution, by reducing a spacing between the fins, and increasing a length in the flowing direction, for example, radiation from a downstream surface of the heating medium is almost fully directed to the fins and the second heating medium channel.

Now, operation of the invention is described below by way of example.

Generally, in a catalytic combustion apparatus, combustion is conducted in such condition that an upstream portion of catalytic element is at the highest temperature, and a large quantity of heat radiated from the upstream surface at the high temperature of catalytic element is made use of.

Thus, by using a catalytic element in the shape of a plate that provides a large apparent surface area, and employing a radiated heat receiving member in a position opposite to the catalytic element, the large quantity of heat radiation conducted from the surface of catalytic element can be received by the radiated heat receiving member. Since the radiated heat receiving member receiving the heat has a channel for passing a heating medium tightly adhered thereto or incorporated therein, the heat is conducted to the channel for passing the heating medium, and further exchanged with the heating medium in the channel.

Now, because the heat is conducted to the radiated heat receiving member by radiative conduction, the heat is evenly removed from the entire catalytic element. Therefore, since unevenness in temperature caused as the combustion heat is removed by direct thermal conduction from a part of the catalytic element is prevented, the large quantity of combustion heat on the catalytic element can be transferred to the heating medium, while stable combustion is maintained. In addition, because the temperature of upstream surface of the catalytic element that is at the highest temperature is reduced by positive heat exchange with the radiated heat receiving member, a higher combustion capacity can be achieved without increasing the temperature of catalytic element to a limit of its heat resistance. As a result, a compact catalytic combustion apparatus using a heating medium for heat exchange can be realized.

Further, by providing the first and second radiated heat receiving members in opposition to respective surfaces of the plate-like catalytic element, because radiation from both surfaces of the catalytic element can be captured by the first and second radiated heat receiving members for heat exchange, and outer surfaces of the catalytic element are simultaneously formed by the first and second radiated heat receiving members, outer surfaces of the catalytic combustion apparatus can be maintained at a low temperature. As a result, radiation loss due to removal of heat by natural convection and radiation from the outer surfaces of catalytic combustion apparatus can be reduced, and an efficiency of heat exchange can be increased.

As heat is removed from the catalytic element to the second radiated heat receiving member, because the temperature of catalytic element is reduced in the opposite side thereof, and the temperature of catalytic element in a side opposite to the first radiated heat receiving member is also reduced due to thermal conduction within the catalytic element, the combustion capacity is further increased. Therefore, a catalytic combustion apparatus providing a high efficiency of heat exchange can be realized in a more compact size.

By providing the second catalytic element in a downstream side of the combustion chamber, since heat radiation from the second catalytic element can be also received by the radiated heat receiving member, an efficiency of heat exchange in the catalytic combustion apparatus can be further increased. Simultaneously, a small quantity of unburned combustibles discharged from the first catalytic element is combusted, and a catalytic combustion apparatus superior in characteristics of an exhaust gas can be achieved.

Further, by providing a radiation absorbing layer in a surface of the radiated heat receiving member, since radiation from a surface of the catalytic element can be very efficiently received by the radiated heat receiving member, an efficiency of heat exchange can be further increased.

By placing the catalytic element above a heat exchanging member for collecting sensible heat in a combustion gas that is produced in the catalytic element, even if condensation of water is caused on the heat exchanging member due to any condition, the water condensed is discharged to outside the combustion apparatus, moving downward from the heat exchanging member in the discharging direction of exhaust gas.

Thus, combusting conditions cannot be affected due to wetting of the catalytic element, and stable combustion can be maintained. Now, although the pH value of water condensed is at 3 or a lower value in the case of inflaming combustion, because NOx is contained in a combustion gas, almost no NOx is contained in the case of catalytic combustion, and no other substance is, therefore, contained in the water condensed except such soluble contents as $CO_2$ and $H_2O$ in a combustion gas. Thus, the pH value is at 6, and corrosion of the heat exchanger by the water condensed can be prevented.

Accordingly, as latent heat in a combustion gas can be collected by positive heat exchange, a catalytic combustion apparatus very high in efficiency of heat exchange can be realized.

DESCRIPTION OF REFERENCE NUMERALS

Figure 1:
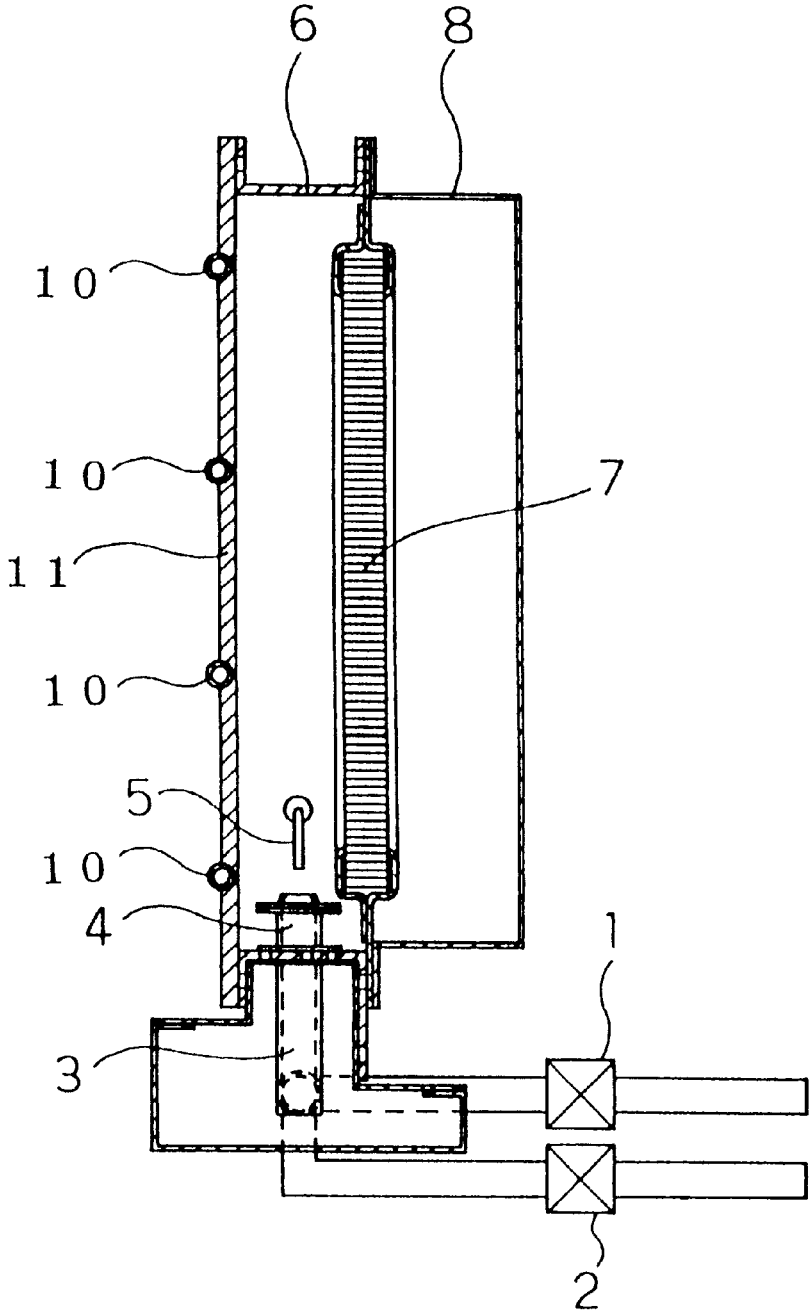
FIG. 1 is a structural view of a catalytic combustion apparatus according to a first embodiment of the invention.

7 Catalytic element
10 Heating medium channel
11 Radiated heat receiving plate
12 Heating medium channel
13 Radiated heat receiving plate
14 First catalytic element
15 Second catalytic element
16 High-capacity radiation absorbing layer
17 Copper tube
18 Radiation absorbing layer
19 Radiated heat receiving plate
20 Copper tube
21 Fin
22 Exhaust path
23 Radiation absorbing layer
24 Heat exchanger

BEST MODE OF CARRYING OUT THE INVENTION

Embodiments of the invention is described below by referring to the drawings.

A catalytic combustion apparatus according to a first embodiment of the invention is described by referring to its structural view in FIG. 1. A fuel supply valve 1 for controlling a supply amount of fuel gas and an air supply valve 2 for controlling a supply amount of air are provided, which are connected with a premixing chamber 3. A preheating burner 4 is located downstream of the premixing chamber 3, a catalytic element 7 basically of a ceramic honeycomb in the shape of a plate with a large apparent surface area is placed downstream thereof, leading to an exhaust outlet 8. In a position opposing to an upstream surface of the catalytic element 7, a radiated heat receiving plate 11 with heating medium channels 10 tightly adhered thereto is employed.

In such construction, a fuel gas supplied from the fuel supply valve 1 and air supplied from the air supply valve 2 are mixed in the premixing chamber 3, and fed to the preheating burner 4. A flame is formed in the preheating burner 4 by an ignition device 5 in the vicinity of the preheating burner 4, and the catalytic element 7 is increased in temperature by a hot exhaust gas produced by the flame. Meantime, a heating medium is allowed to flow through a heating medium channel or duct 10. As soon as the catalytic element 7 reaches a temperature at which it is active, supply of the fuel gas is temporarily discontinued by the fuel supply valve 1, and the flame is distinguished. As the fuel is supplied by the fuel supply valve 1 immediately after that, catalytic combustion is initiated in the catalytic element 7.

The heating medium receives a large quantity of heat, is increased in temperature, and comes to be hot, while it passes through the heating medium channel or duct 10. By using the heating medium, only specified object and place can be heated. For example, hot-water supply system can be realized by directly using the heating medium as water, and the heating medium can also be used for floor heating by allowing it to flow through tubes arranged below a floor.

During catalytic combustion, the upstream surface of plate-like catalytic element 7 is heated to a temperature as high as 800° C. to 850° C. by combustion heat, and a large quantity of heat is radiated from the upstream surface of catalytic element 7. Because the radiated heat receiving plate 11 is located in a position opposing to the upstream surface of catalytic element 7, the radiated heat receiving plate receives the large quantity of radiation from the catalytic element 7. Since the heating medium channel or duct 10 is tightly adhered to the radiated heat receiving plate 11, and the heating medium flows there through in the duct, a quantity of heat received by the radiated heat receiving plate 11 is conducted by thermal conduction to the heating medium, and the heating medium is increased in temperature.

Now, according to the structure, because conduction of heat from the catalyst 7 to the radiated heat receiving plate 11 is achieved by radiation, heat is evenly removed from an entire surface of the catalytic element 7, and the surface of catalytic element 7 is uniform in temperature, even though a large quantity of heat is removed. If the heat from the catalytic element 7 is conducted directly by thermal conduction, the temperature of catalyst is reduced in the vicinity of a part from which the heat is removed, unevenness in temperature is caused on the catalytic element 7, and combustion may possibly be unstable.

Thus, by using the radiated heat receiving plate 11, combustion heat is conducted to the heating medium without affecting the combusting condition of catalytic element.

Because most of the heat radiated from the upstream surface of catalytic element 7 is conducted to the heating medium as described above, the radiated heat receiving plate 11 forming a heat receiving member is at a low temperature. As a result, a large quantity of combustion heat is radiated from the upstream surface of catalytic element 7, the temperature of upstream surface of the catalytic element 7 is reduced. Since the catalytic element 7 is at a high temperature in an upstream part during catalytic combustion, the highest temperature in the catalytic element 7 is lowered by the large quantity of heat radiation.

Therefore, even if a combustion capacity is increased, because the catalytic element 7 is unlikely heated to a temperature limit of its heat resistance, a combustion capacity can be increased, and a catalytic combustion apparatus compact in relation to the combustion capacity can be realized.

Figure 2:
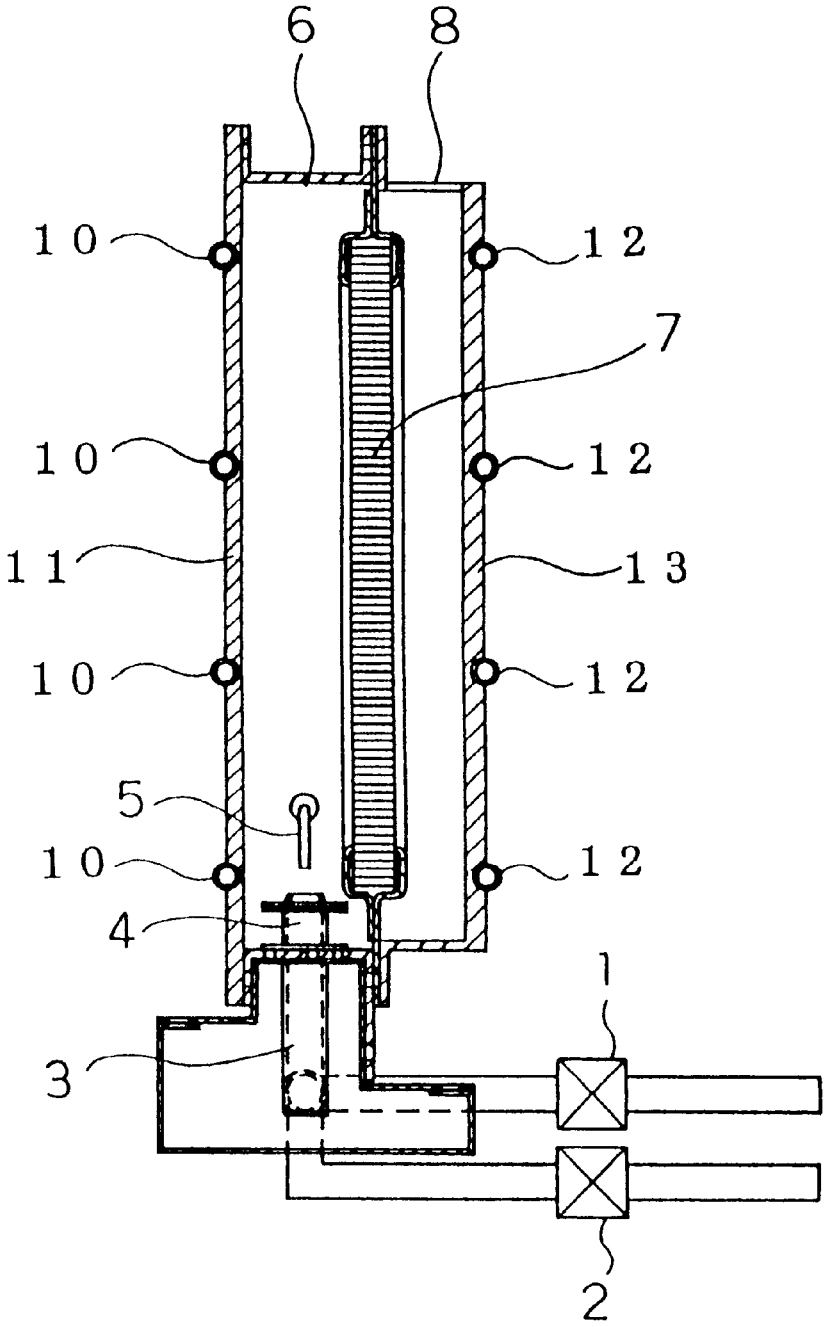
FIG. 2 is a structural view of a catalytic combustion apparatus according to a second embodiment of the invention.

A catalytic combustion apparatus according to a second embodiment of the invention is described by referring to its structural view in FIG. 2. The catalytic combustion apparatus according to the invention further comprises a radiated heat receiving plate 13 with heating medium channels 12 in a position opposite to a downstream surface of the catalytic element 7.

Because the downstream surface of catalytic element 7 is also at a high temperature during catalytic combustion, by providing the radiated heat receiving plate 13 in such position that it receives radiation from the downstream surface of catalytic element 7, heat radiated from the downstream surface of catalytic element 7 is also exchanged with a heating medium, and an efficiency of heat exchange in a catalytic combustion apparatus can be increased. Further, because of such heat exchange, since the temperature of downstream surface of the catalytic element 7 is reduced, that of upstream surface of the catalytic element 7 is also reduced. Therefore, the combustion capacity is further increased, and the size of a catalytic combustion apparatus can be further reduced.

Since the radiated heat receiving plates 11 and 13 form walls of a combustion chamber 6, and most of combustion heat in the catalytic element 7 is exchanged with the heating medium, increase in temperature of the walls of combustion chamber 6 is restricted. Therefore, as almost no radiation loss is caused due to thermal conduction by natural convection and radiation from walls of the catalytic combustion apparatus, an efficiency of heat exchange comes to be high.

Figure 3:
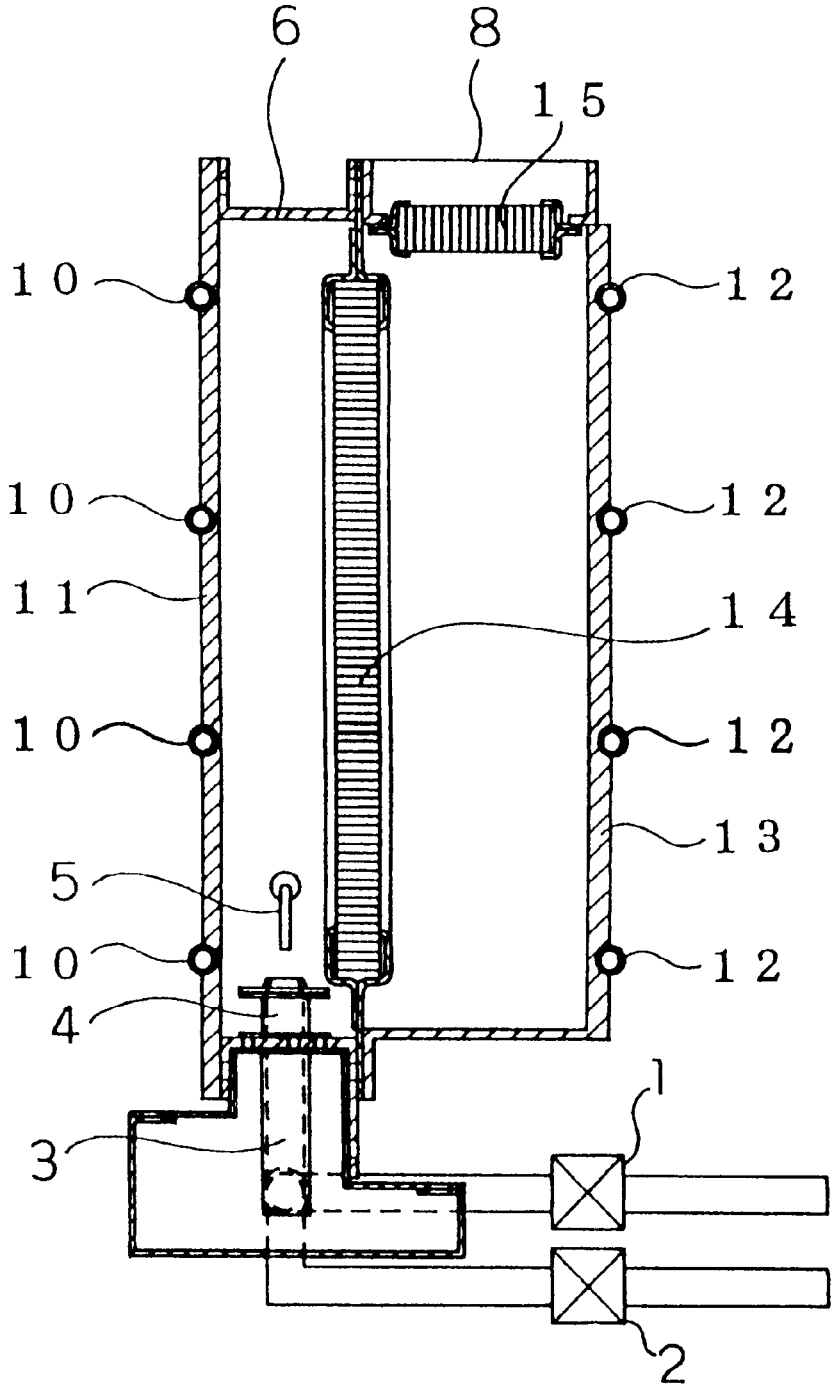
FIG. 3 is a structural view of a catalytic combustion apparatus according to a third embodiment of the invention.

A catalytic combustion apparatus according to a third embodiment of the invention is described by referring to its structural view in FIG. 3. The catalytic combustion apparatus according to the embodiment comprises a first catalytic element 14 basically of a ceramic honeycomb plate and a second catalytic element 15 basically of a ceramic honeycomb plate downstream of the radiated heat receiving plate 13.

During catalytic combustion, the second catalytic element 15 is heated to a temperature at which it is active by a hot exhaust gas from the first catalytic element 14. Thus, a small quantity of unburned combustibles contained in a combustion gas from the first catalytic element 14 is completely combusted at the second catalytic element 15, and discharged from an exhaust outlet 8 as an exhaust gas containing no unburned combustible.

In such operation, an upstream surface of the second catalytic element 15 is also at a high temperature due to the combustion gas from the first catalytic element 14 and combustion heat in the second catalytic element 15, and heat is removed by radiation from the upstream surface of second catalytic element 15.

However, because the radiated heat receiving plate 13 is provided in the upstream side of second catalytic element 15, radiation from the upstream surface of second catalytic element 15 is received by the radiated heat receiving plate 13, and exchanged with the heating medium.

As a result, since the heat radiated from the upstream and downstream surfaces of first catalytic element 14 as well as the upstream surface of second catalytic element 15 is exchanged with the heating medium, a catalytic combustion apparatus providing a very high efficiency of heat exchange can be realized.

Figure 4:
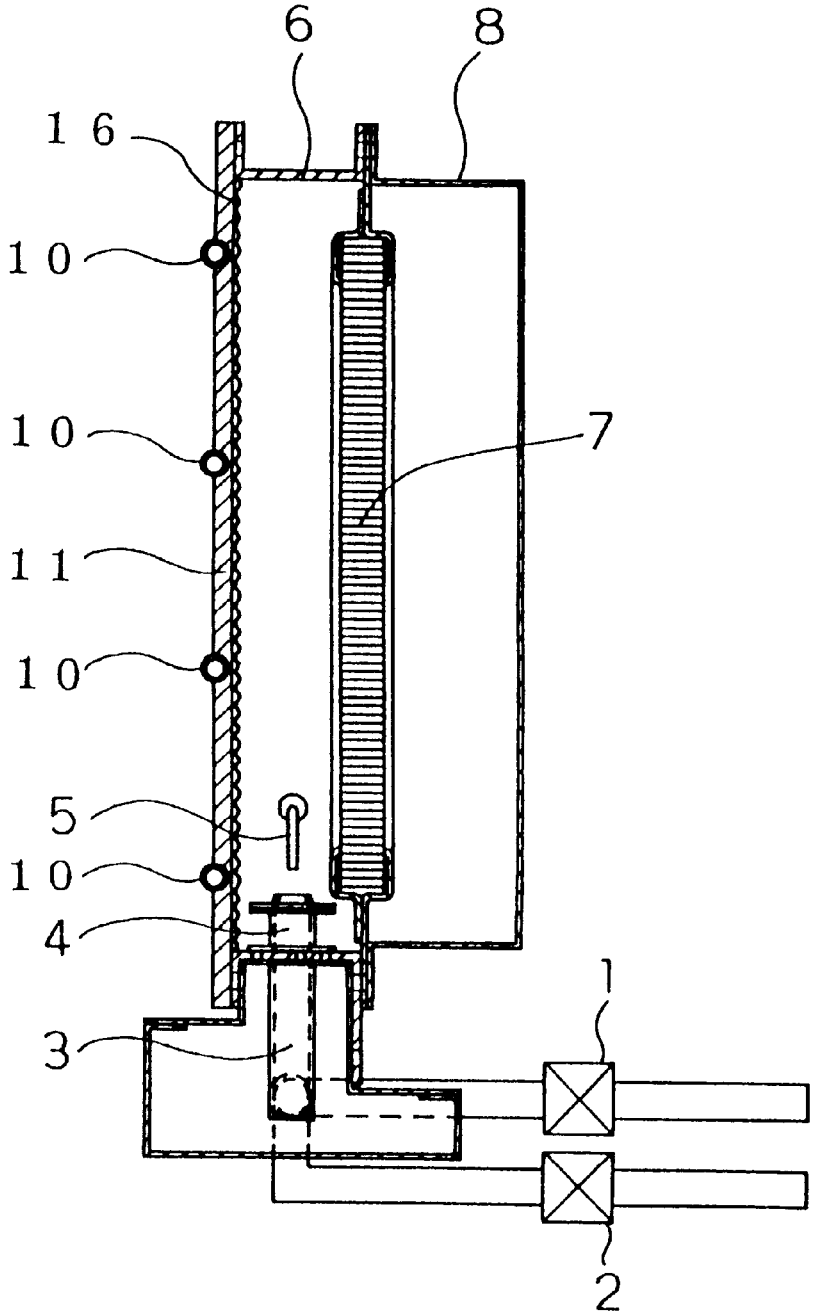
FIG. 4 is a structural view of a catalytic combustion apparatus according to a fourth embodiment of the invention.

A catalytic combustion apparatus according to a fourth embodiment of the invention is described by referring to its structural view in FIG. 4. The catalytic combustion apparatus according to the embodiment comprises a high-capacity radiation absorbing layer 16 with a black paint applied to an inner surface of the radiated heat receiving plate 11.

As a coefficient of radiation of the black paint is at 0.9 to 1.0, radiation from the upstream surface of catalytic element 7 is very efficiently received by the high-capacity radiation absorbing layer 16, conducted to the radiated heat receiving plate 11, and exchanged with the heating medium. Thus, an efficiency of heat exchange can be increased. Because of a higher efficiency of heat exchange, a quantity of heat conducted from the upstream surface of catalytic element 7 to the radiated heat receiving plate 11, that is, a quantity of heat removed from the upstream surface of catalytic element 7 is increased, and the temperature of upstream surface of the catalytic element 7 is reduced.

As a result, since a higher combustion capacity can be obtained at a temperature below a limit of the heat resistance, the size of a catalytic combustion apparatus can be reduced.

By providing a high-capacity radiation absorbing layer in an inner surface of the combustion chamber 6 in addition to the radiated heat receiving plate 11, and increasing thermal conduction to the radiated heat receiving plate 11, the heat radiated from the upstream surface of catalytic element 7 can be surely received by the high-capacity radiation absorbing layer formed in an entire area in the upstream side of catalytic element 7, and exchanged with the heating medium.

As for the high-capacity radiation absorbing layer 16, such additional layer having a high coefficient of radiation as above-described black paint coating and plating may be formed in a surface of the radiated heat receiving plate 11, or a coefficient of radiation may be increased by forming fine recesses and projections in a surface of the radiated heat receiving plate by such method as sand blasting.

In the first to fourth embodiments, by providing such heat exchanger as a fin-tube type downstream of the catalytic element 7 or second catalytic element 15 for collecting latent heat in the exhaust gas, and allowing a heating medium to flow there through for exhaust heat recovery, the efficiency of heat exchange can be further increased.

Figure 5:
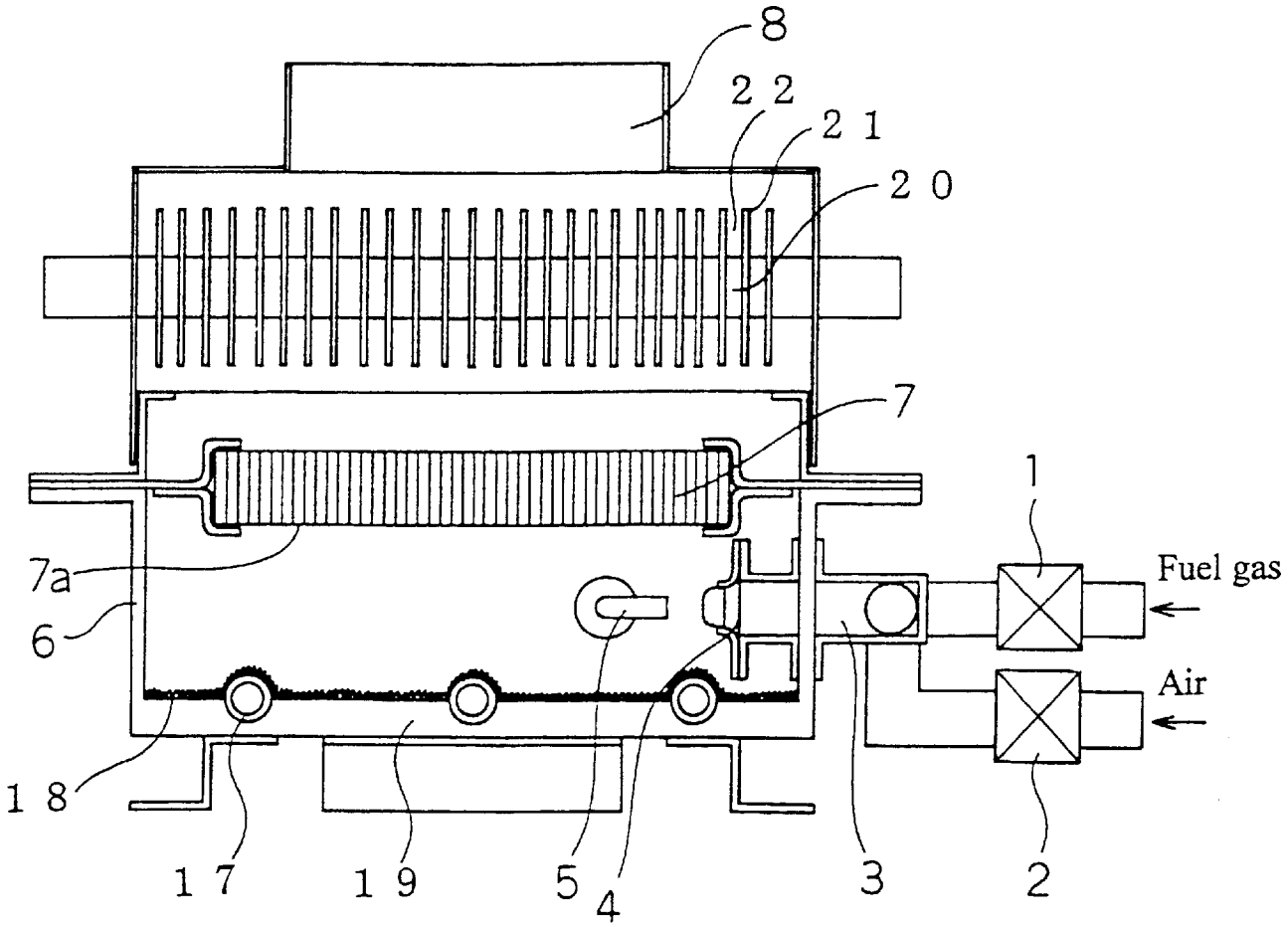
FIG. 5 is a structural view of a catalytic combustion apparatus according to a fifth embodiment of the invention.

A catalytic combustion apparatus according to a fifth embodiment of the invention is described by referring to its structural view in FIG. 5. The catalytic combustion apparatus according to the embodiment comprises a fuel supply valve 1 for controlling a supply amount of fuel gas and an air supply valve 2 for controlling a supply amount of air, which are connected with a premixing chamber 3. A preheating burner 4 is located downstream of the premixing chamber 3, leading to a combustion chamber 6. In the combustion chamber 6, a catalytic element 7 consisting of a ceramic honeycomb that has multiple through-holes as a support and a radiated heat receiving plate 19 provided with copper tubes 17 that is tightly adhered thereto as first heating medium channels in positions opposite to an upstream surface 7*a* of the catalytic element 7 for allowing water to flow there through and a radiation absorbing layer 18 are placed. In addition, at an outlet of the combustion chamber 6, a copper tube 20 having multiple fins 21 is employed as second heating medium channels, and connected with the copper tubes 17. The outlet of combustion chamber 6 leads to an exhaust outlet 8. The fins 21 are attached to the copper tube 20 in such manner that a small spacing is formed between the fins 21 as an exhaust path 22.

In such construction, the fuel gas supplied from the fuel supply valve 1 and air supplied from the air supply valve 2 are mixed in the premixing chamber 3, and fed to the preheating burner 4. Meantime, water is allowed to flow through the copper tubes 17 and 20. A flame is formed in the preheating burner 4 by an ignition device 5 in the vicinity of the preheating burner 4, and the catalytic element 7 is increased in temperature by a hot exhaust gas produced by the flame. As soon as the catalytic element 7 reaches a temperature at which it is active, supply of the fuel gas is temporarily discontinued by the fuel supply valve 1, and the flame is distinguished. As the fuel is supplied by the fuel supply valve 1 immediately after that, catalytic combustion is initiated in the catalytic element 7. A hot exhaust gas discharged from the catalytic element 7 is discharged from the exhaust outlet 8 through the exhaust path 22.

During steady combustion, the upstream surface 7*a* of catalytic element 7 is at a temperature of 800° C. to 850° C., and a downstream surface at 600° C. to 750° C., thus a large quantity of heat is radiated from the upstream and downstream surfaces of catalytic element 7. According to the embodiment, because the fins 13 are placed with a sufficiently small spacing between them, most radiation from the downstream surface of catalytic element 7 is directly received by the fins 21 or copper tube 20. Now, since the fins 21 are generally of copper, the coefficient of radiation is at 0.2 to 0.3. Therefore, although a part of the radiation is conducted to the fins 21 and copper tube 20, and the heat is exchanged with water, still other part is reflected by a surface of the fins 21 and copper tube 20, and directed to the downstream surface of catalytic element 7. If it is directed to the downstream surface of catalytic element 7, as thermal conduction to the downstream side within the catalytic element 7 is disturbed, the entire catalytic element 7 is increased in temperature. Accordingly, the upstream surface 7*a* of catalytic element 7 already at a high temperature is further increased in temperature, and a large quantity of radiation is caused from the upstream surface 7*a* of catalytic element 7. Since the radiated heat receiving plate 19 provided with the radiation absorbing layer 18 in an inner surface thereof and the copper tubes 17 tightly adhered thereto is employed in a position opposite to the upstream surface 7*a* of catalytic element 7, the heat radiated from the upstream surface 7*a* of catalytic element 7 is transmitted to the radiated heat receiving plate 19, and exchanged with water. It means that even the heat radiation reflected by the fins 21 and copper tube 20 is exchanged with water. Heat of the hot exhaust gas caused by the combustion heat in the catalytic element 7 is conducted by thermal conduction to the fins 21 and copper tube 20 as it passes through the exhaust path 22, and exchanged with water. As a result, because most heat radiated from the surface of catalytic element 7 is exchanged without being discharged to outside the catalytic combustion apparatus, a catalytic combustion apparatus providing a high efficiency of heat exchange can be realized.

The fins 21 may be further elongated in the flowing direction, so that radiation from the downstream surface of catalytic element 7 can be almost fully directed to the copper tube and fins.

Alternatively, the fins 21 may be only placed at least in positions opposite to respective ends of the catalytic element 7. It provides for solving such problem as described in connection with the prior art that the catalytic element comes to be lower in temperature in the vicinity of a catalytic element holder, the catalytic activity is locally reduced, and an exhaust gas containing unburned combustibles is discharged.

Figure 8A:
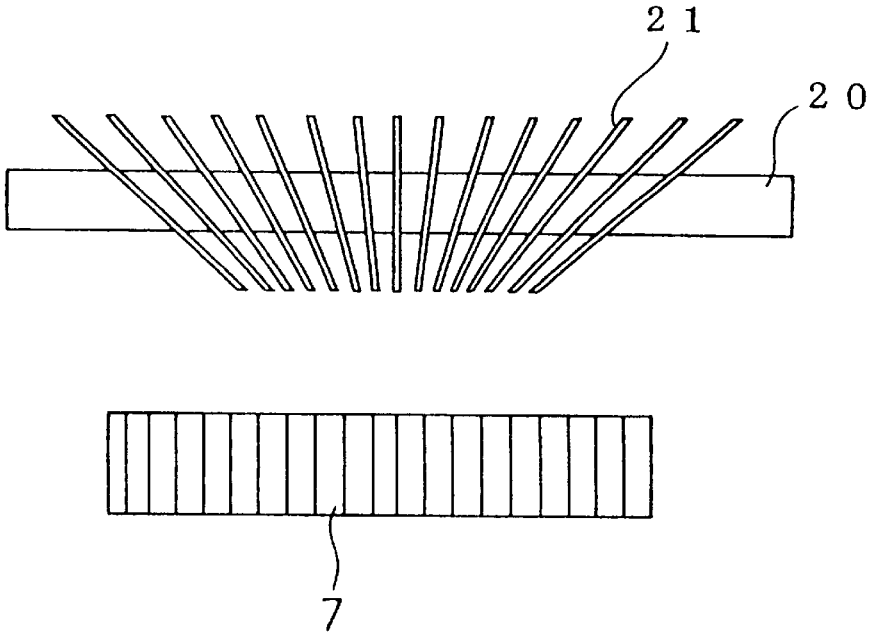
FIG. 8 is a view of a catalytic combustion apparatus according to the fifth embodiment, showing another example of attachment of fins.
Figure 8B:
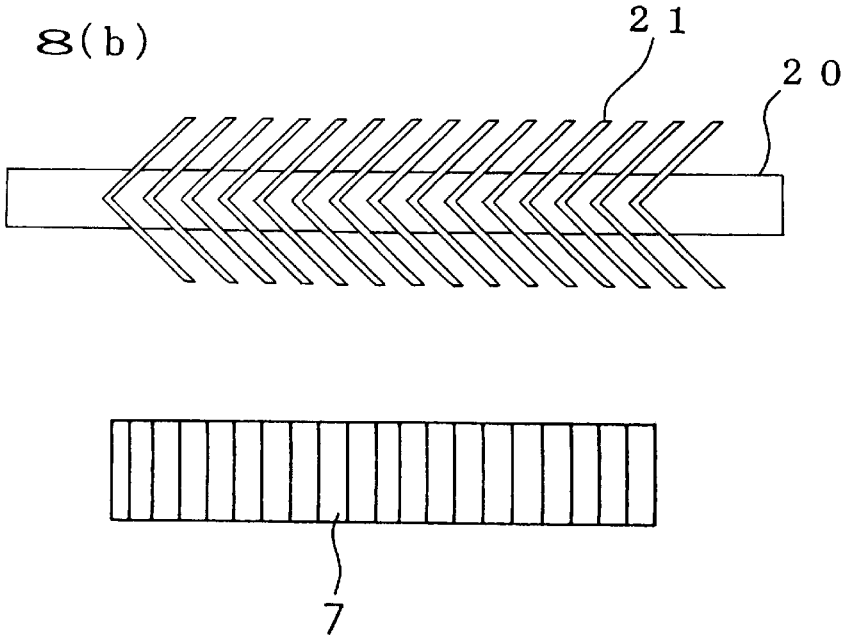
Figure 9:
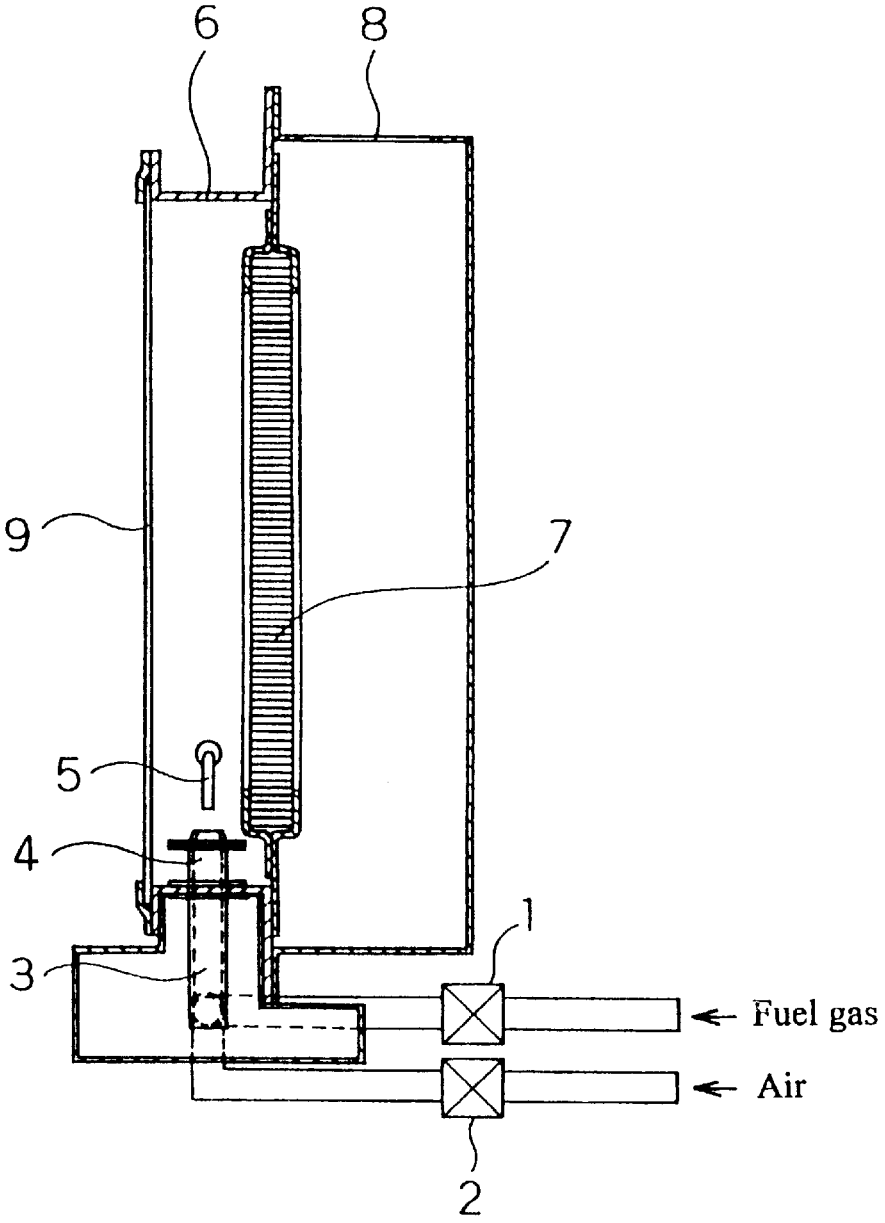
Fig. 9 PRIOR ART
FIG. 9 is a structural view of a conventional catalytic combustion apparatus.

In the first embodiment, although the fins 21 are positioned in the direction perpendicular to the surface of catalytic element 7, the invention is not limited thereto, and the fins 21 may be positioned, for example, radially in relation with the surface of catalytic element 7 as shown in FIG. 8(*a*). Alternatively, the fins 21 may be bent in the middle thereof, as shown in FIG. 8(*b*).

Figure 6:
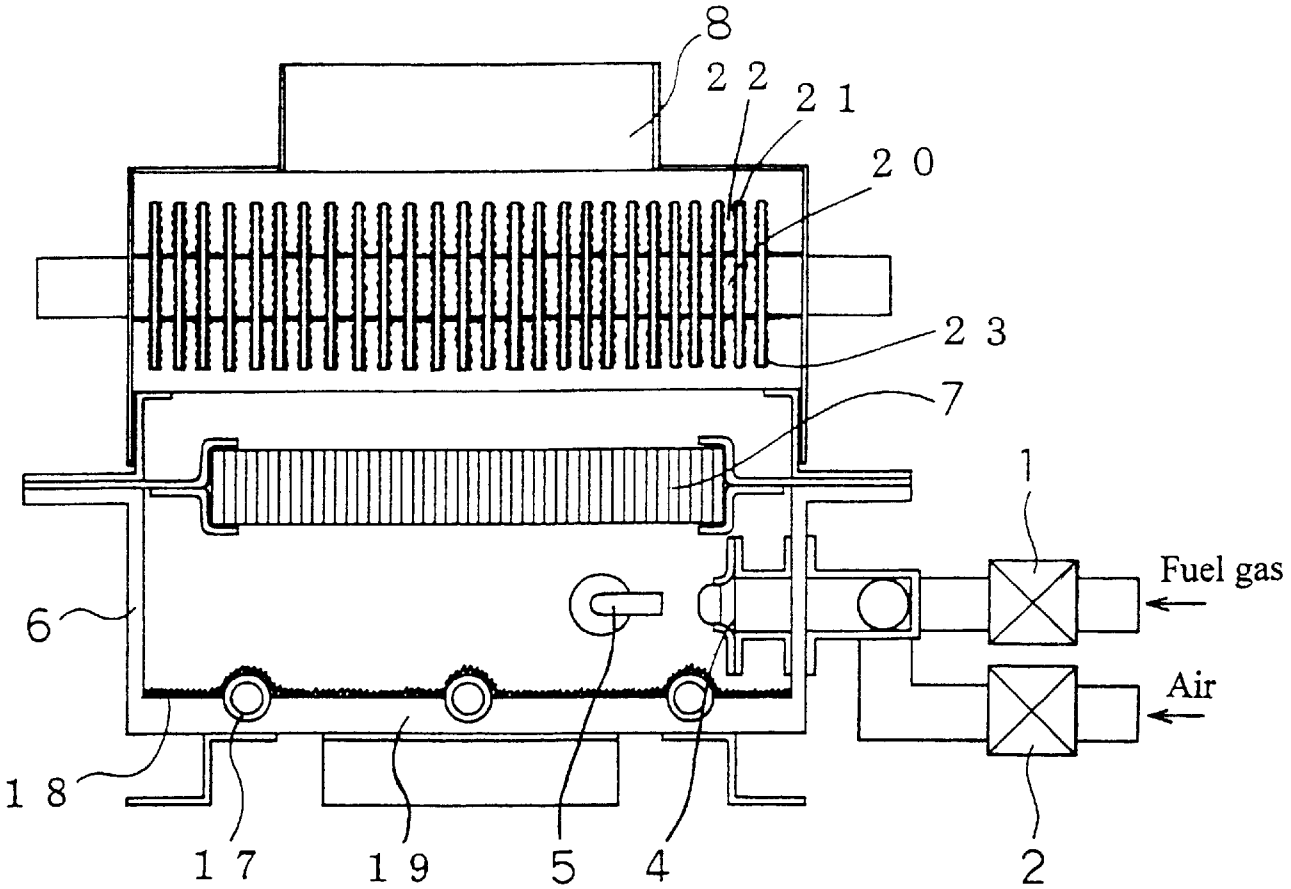
FIG. 6 is a structural view of a catalytic combustion apparatus according to a sixth embodiment of the invention.

A catalytic combustion apparatus according to a sixth embodiment of the invention is described by referring to its structural view in FIG. 6. In addition to the components of above embodiment 5, a radiation absorbing layer 23 is provided in surfaces of the fins 21 and copper tube 20.

In the embodiment, radiation of heat directed from the downstream surface of catalytic element 7 to the fins 21 and copper tube 20 is efficiently absorbed by the radiation absorbing layer 23, and the heat is exchanged with water. Therefore, because the radiation of heat from the downstream surface of catalytic element 7 is almost fully absorbed by the fins 21 and copper tube 20, and exchanged, a catalytic combustion apparatus providing a high efficiency of heat exchange can be realized.

As for the radiation absorbing layer 23, the surfaces of fins 21 and copper tube 20 may be coated with a thin layer of black paint having a high coefficient of radiation, or the coefficient of radiation may be increased by a blasting process or the like for roughing the surfaces.

Figure 7:
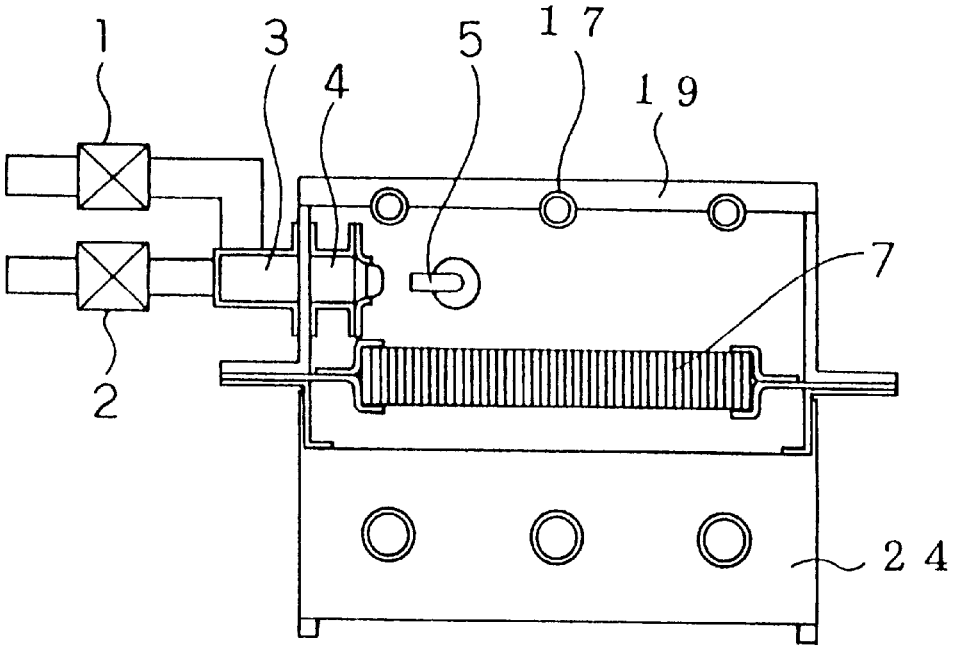
FIG. 7 is a structural view of a catalytic combustion apparatus according to a seventh embodiment of the invention.

A catalytic combustion apparatus according to a seventh embodiment of the invention is described by referring to its structural view in FIG. 7. A radiated heat receiving plate 19 with heating medium channels 17 is provided in a position opposite to an upstream surface of a catalytic element 7, and a heat exchanger 24 of fin-tube type allowing a heating medium to flow there through is located below the catalytic element 7.

It is known that almost no NOx is contained in an exhaust gas caused by catalytic combustion. Therefore, when an exhaust gas is condensed, the pH value of condensed water is lower than 3 in the case of inflaming combustion, while the pH value of about 6 is found in the case of catalytic combustion, because the condensed water contain almost no nitric acid. As a result, even when water contained in a combustion gas is condensed on a surface of the heat exchanger 24, corrosion in the surface of heat exchanger is never caused by the condensed water in the case of catalytic combustion.

It is positively made use of in the catalytic combustion apparatus according to the embodiment, and an exhaust gas discharged from the exhaust gas heat exchanger is adapted to be at a temperature not higher than a dew-point temperature in the exhaust gas heat exchanger. By means of such arrangement, water in a combustion gas entering the heat exchanger 24 is condensed on a heat exchanging surface, when it exchanges heat on a surface of the heat exchanger 24. As described above, because the pH value of condensed water in the combustion gas is at about 6 in the case of catalytic combustion, even if water is condensed on a surface of the heat exchanger, no problem is caused. Accordingly, when a combustion gas emitted by catalytic combustion is subjected to heat exchange by the heat exchanger 24, latent heat exchange can be also achieved in addition to conventional sensible heat exchange, an efficiency of heat exchange can be increased in comparison with conventional inflaming combustion method.

An operation of a catalytic combustion apparatus providing above-mentioned effects is described by referring to FIG. 7.

A combustion gas caused in the catalytic element 7 is introduced to the heat exchanger 24, and discharged downward after heat exchange. Even when condensation of water is caused on the heat exchanger 24, since it drops downward, that is, in the discharging direction of the combustion gas according to the gravity, it never affects combustion in the catalytic element 7 which is above the heat exchanger 24. Thus, as a result of positive heat exchange in the heat exchanger 24, latent heat of $H_2O$ in the combustion gas can be also exchanged. In the upstream side of catalytic element 7, because the heat radiated from the upstream surface of catalytic element is exchanged by the radiated heat receiving plate 19, a catalytic combustion apparatus providing a very high efficiency of heat exchange as a whole can be achieved.

Below the heat exchanger 24, a draining channel for collecting and draining condensed water may be provided.

In the first to seventh embodiments, an ignition device may be employed as igniting means in the downstream side of catalytic element (first catalytic element). In such case, upon ignition, a flame is formed in the downstream surface of catalytic element, and the catalytic element is increased in temperature by the flame. Although the catalytic combustion is naturally initiated, as soon as the catalytic element reaches a temperature at which it is active, since an exhaust gas caused by the catalytic combustion is simultaneously applied to the flame in the downstream side of catalytic element, the flame is distinguished. Therefore, by providing an ignition device in the downstream side of catalytic element, natural shift from inflaming combustion for preheating to catalytic combustion can be achieved without controlling a fuel supply. As an ignition device, a ceramic heater may be used for heating a premixed gas locally to an ignition temperature or a higher temperature, or an igniter may be employed for applying a spark to a frame of the catalytic element or a wall of the catalytic combustion apparatus.

Industrial Applicability

As clearly shown in above description, according to the invention, a catalytic combustion apparatus providing a high efficiency of heat exchange can be achieved in a compact size by using a catalytic element in the shape of a plate, and allowing a radiated heat receiving plate with heating medium channels to receive a large quantity of heat radiated from a surface of the catalytic element for heat exchange with the heating medium.

Further, by directing a full quantity of radiation from a downstream surface of the catalytic element to the heating medium channels, a catalytic combustion apparatus providing even higher efficiency of heat exchange can be realized. Also, because stable combustion can be maintained even when condensation of water is caused, by placing the catalytic element above a heat exchanger, and latent heat of $H_2O$ in a combustion gas can be also collected by the heat exchanger because of positive heat exchange, a catalytic combustion apparatus providing a very high efficiency of heat exchange can be achieved.

What is claimed is:

1. A catalytic combustion apparatus comprising:

a fuel supply member for supplying a fuel;

an air supply member for supplying air;

a premixing chamber for mixing the fuel supplied from the fuel supply member and the air supplied from the air supply member to make a mixed gas, the mixed gas flowing from the premixing chamber in a downstream flow direction;

a catalytic element including two opposing surfaces and a porous member for catalytically combusting the mixed gas and emitting radiant heat;

a combustion chamber provided downstream of the premixing chamber, having two opposing side walls facing each other and each having a longitudinal dimension along the flow direction, one of the opposing side walls including a first radiated heat receiving member, and in the other of the opposing side walls including a second radiated heat receiving member and the catalytic element disposed within the combustion chamber, wherein said first radiated heat receiving member is facing one of said two opposing surfaces of said catalytic element and said second radiated heat receiving member is facing the other of said two opposing surfaces, wherein said first and second radiated heat receiving members are provided with ducts tightly adhered thereto and incorporated therein, and a heating medium is provided to flow within the ducts and wherein said heating medium is used in an exterior of said catalytic combustion apparatus, and a second catalytic element in the shape of a plate having a porous member disposed at an outlet of the combustion chamber, and adjacent a downstream end of said second radiated heat receiving member, to enhance heat exchange between said second catalytic element and said second radiated heat receiving member.

2. A catalytic combustion apparatus according to claim 1, wherein the heating medium is a liquid.

3. A catalytic combustion apparatus according to claim 1, wherein the heating medium is a gas.

4. A catalytic combustion apparatus according to claim 1, wherein the ducts are disposed transversely to the downstream flow direction and have a liquid flowing therein.

5. A catalytic combustion apparatus according to claim 1, wherein said liquid is used for heating an area in said exterior.

6. A catalytic combustion apparatus according to claim 1, wherein a radiation absorbing layer is provided in a surface of the radiated heat receiving member within the combustion chamber.

7. A catalytic combustion apparatus according to claim 1, wherein a radiation absorbing layer is provided in a surface of the other radiated heat receiving member within the combustion chamber.

8. A catalytic combustion apparatus according to claim 1 or claim 5, wherein a second catalytic element in the shape of a plate having a porous member is disposed at an outlet of the combustion chamber for enhancing heat exchange with said liquid within said ducts of said second radiated heat receiving member and the outlet positioned at a downstream end of the combustion chamber for permitting exhaust gas to exit the combustion chamber.

9. A catalytic combustion apparatus comprising:

a catalytic element having multiple through-holes for combusting a mixed gas of a fuel and air and emitting radiant heat;

a combustion chamber housing the catalytic element, and having a radiated heat receiving plate located in opposition to a surface of the catalytic element on an upstream side of a flowing direction of the mixed gas;

a first set of ducts provided in the radiated heat receiving plate; and a heating medium provided to flow within the first set of ducts;

a second duct having a heating medium flowing therein located in opposition to a downstream side of the catalyst element, and having multiple fins extending from the duct;

wherein the multiple fins are spaced apart from each other to form exhaust paths between the fins for channeling exhaust gas in the downstream direction from the catalytic element and wherein said radiated heat receiving plate is a part of a side wall of said combustion chamber.

10. A catalytic combustion apparatus according to claim 9, wherein the fins are positioned at an angle to a surface of the catalytic element.

11. A catalytic combustion apparatus according to claim 9, wherein a radiation absorbing layer is provided on exterior surfaces of the first set of ducts, the second duct and fins.

12. A catalytic combustion apparatus according to claim 9, wherein said heating medium is liquid and said liquid is used for heating an area in an exterior of said catalytic combustion apparatus.

* * * * *